US005121312A

United States Patent [19]

Hyland et al.

[11] Patent Number: 5,121,312

[45] Date of Patent: Jun. 9, 1992

[54] UNIVERSAL FOLDABLE LAMP SHADE OVERSHADE

[76] Inventors: Joseph F. Hyland; Barbara B. Hyland, both of 3298 Casey Key Rd., Nokomis, Fla. 34275

[21] Appl. No.: 621,594

[22] Filed: Dec. 3, 1990

[51] Int. Cl.[5] ..... F21V 1/06

[52] U.S. Cl. ..... 362/352; 362/360; 362/457; 362/806

[58] Field of Search ..... 362/352, 360, 457, 806

[56] References Cited

U.S. PATENT DOCUMENTS

| | | | |
|---|---|---|---|
| 4,605,996 | 8/1986 | Payne | 362/352 |
| 4,646,216 | 2/1987 | Chong et al. | 362/352 |
| 4,731,715 | 3/1988 | Anderson | 362/361 X |

FOREIGN PATENT DOCUMENTS

| | | | |
|---|---|---|---|
| 611477 | 10/1948 | United Kingdom | 362/352 |

*Primary Examiner*—Allen M. Ostrager

*Attorney, Agent, or Firm*—Charles J. Prescott

[57] ABSTRACT

A universal foldable lamp shade overshade which includes a uniformly pleated rectangular sheet of thin, somewhat rigid yet bandeable material having a plurality of side-by-side slender elongated panels integrally connected one to another in accordion fashion along a fold line between each panel. A hole is formed through each panel adjacent its upper end through which a draw string is positioned in in-and-out fashion through alternate holes. The side margins of the pleated sheet are connected to form a somewhat tubular member which is sized, when reduced in circumference at its upper end by tightening the drawstring, to be held in place primarily by gravity over and substantially covering a lamp shade.

9 Claims, 2 Drawing Sheets

Fig. 5
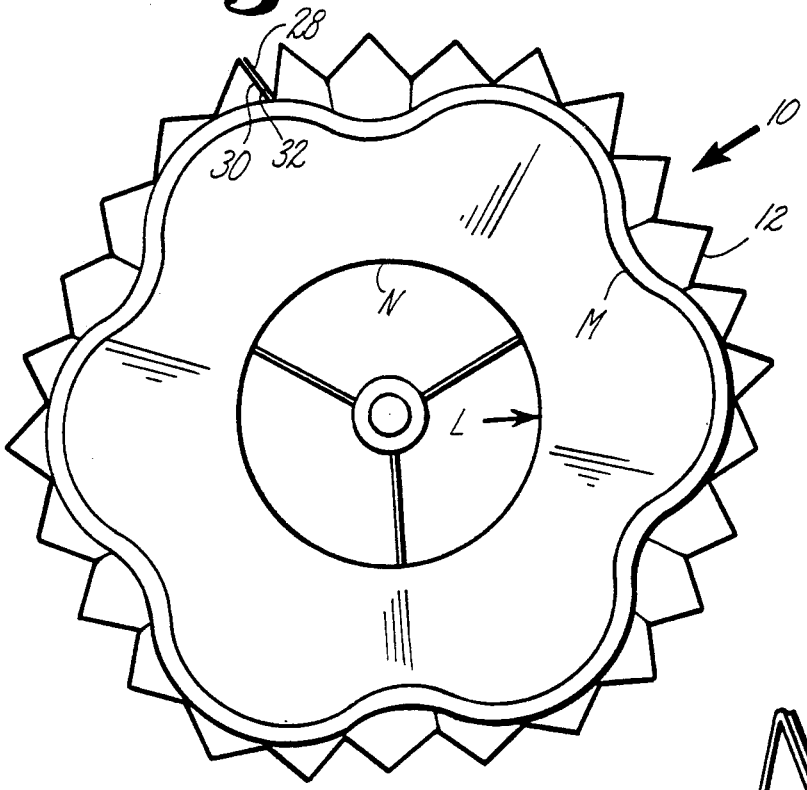
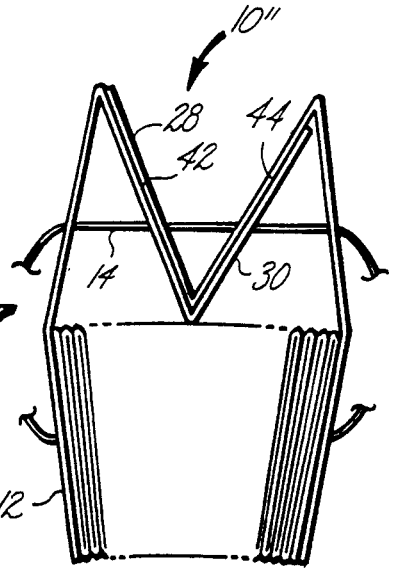
Fig. 7
Fig. 6
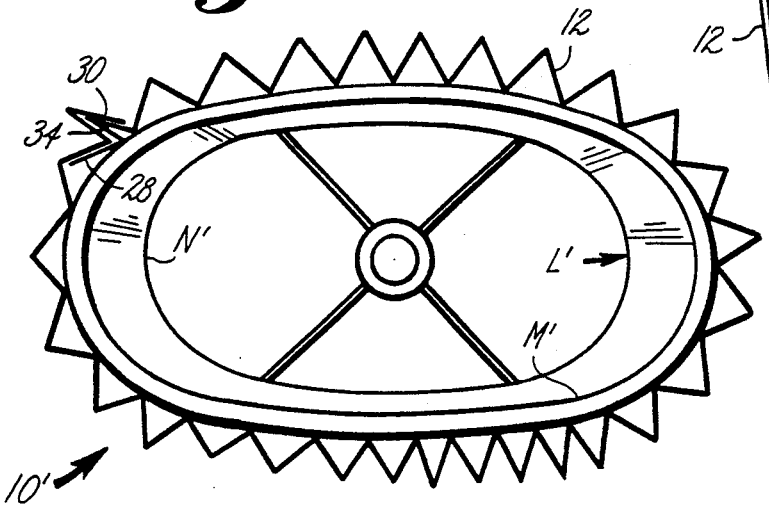

UNIVERSAL FOLDABLE LAMP SHADE OVERSHADE

BACKGROUND OF THE INVENTION

This invention is generally related to lamp shades, and more particularly to a removable, universal, foldable lamp shade overshade.

The construction of conventional lamp shades is well known and typically require replacement long before the lamp itself is either worn or desired to be replaced for decorative considerations. However, in replacing a conventional lamp shade, both size and decorative considerations become somewhat restrictive in selecting a replacement.

Additionally, seasonal or festive considerations may make it desirable to temporarily alter the appearance of one or more lamp shades in a room or home setting.

One such device for accomplishing this is disclosed in U.S. Pat. No. 4,731,715 to Anderson which is directed to a conformable covering fabricated from a rectangular swath of cloth which may be fitted over a conventional lamp shade.

Other uniquely constructed lamp shades and lamp shade covers are as follows:

| | |
|---|---|
| Gottlieb | 3,161,358 |
| Washick | 3,385,963 |
| Weisbrod | 4,055,760 |
| Gall | 4,354,222 |
| Payne | 4,625,268 |
| Naumoff, et al. | 4,727,461 |

However, none of these references are of a nature similar to that of the present invention.

The present invention provides a universal, foldable lamp shade overshade which may be manufactured from any convenient semi-rigid decorative material which is formed into a uniformly pleated rectangular sheet bendable primarily about the fold lines between each slender panel in accordion fashion. This structure includes a drawstring adjacent the upper end and has sufficient pliability about the fold lines so as to conform to a broad range of lamp shade sizes of perimeters and lengths and shapes. Moreover, the device is structured so as to rest atop a tapered lamp shade held thusly primarily by gravity, requiring no additional connecting means between the device and the lamp shade. Compact storage is also provided.

BRIEF SUMMARY OF THE INVENTION

This invention is directed to a universal foldable lamp shade overshade which includes a uniformly pleated rectangular sheet of thin, somewhat rigid yet bendable material having a plurality of side-by-side slender elongated panels integrally connected one to another in accordion fashion along a fold line between each panel. A hole is formed through each panel adjacent its upper end through which a draw string is positioned in in-and-out fashion through alternate holes. The side margins of the pleated sheet are connected to form a somewhat tubular member which is sized, when reduced in circumference at its upper end by tightening the drawstring, to be held in place primarily by gravity over and substantially covering a lamp shade.

It is therefore an object of this invention to provide a universal, foldable lamp shade overshade which may be fabricated from a virtually limitless selection of semi-rigid, bendable decorative materials.

It is another object of this invention to provide a universal lamp shade overshade which will decoratively cover a conventional lamp shade, thus providing a completely different decorative lamp shade appearance without the need for lamp shade replacement.

It is yet another object of this invention to provide a universal lamp shade overshade which is expandable to fit over and cover a very broad range of lamp shade sizes of perimeters and lengths and shapes.

It is yet another object of this invention to provide a universal lamp shade overshade which may substantially alter the decorative length configuration of a conventional lamp shade.

It is yet another object of this invention to be compactly storable.

In accordance with these and other objects which will become apparent hereinafter, the instant invention will now be described with reference to the accompanying drawings.

BRIEF DESCRIPTION OF THE DRAWINGS

FIG. 5 is a view in the direction of arrows 5—5 in FIG. 2.

FIG. 6 is a view similar to FIG. 5 in conjunction with an irregularly shaped lamp shade.

FIG. 7 is an end view of the invention in its stored configuration and showing yet another configuration for connecting the side margins of the pleated sheet.

DETAILED DESCRIPTION OF THE INVENTION

Figure 1:
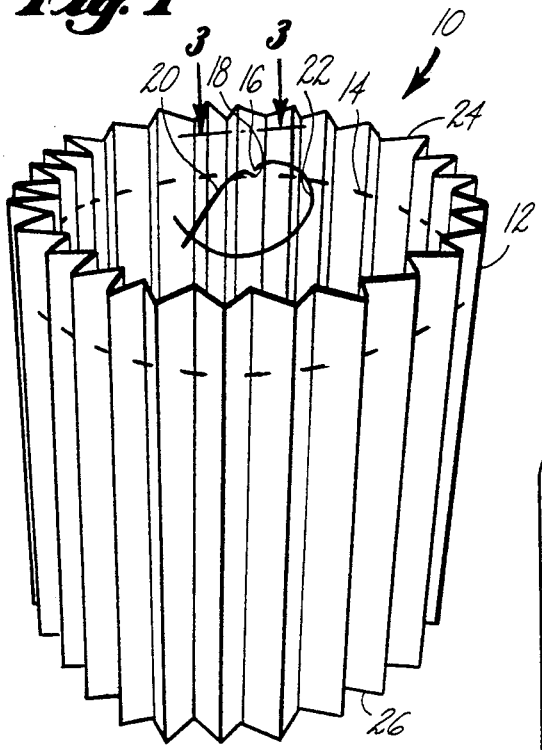
FIG. 1 is a perspective view of the preferred embodiment of the invention in its relaxed configuration.

Referring now to the drawings, and particularly to FIG. 1, the preferred embodiment of the invention is shown generally at numeral 10. This overshade 10 is fabricated of a pleated sheet 12 formed of relatively stiff, yet foldable decorative material sufficiently rigid so as to maintain a free-standing shape as shown in FIG. 1, yet sufficiently pliable so as to be expandable in accordion fashion.

Figure 3:
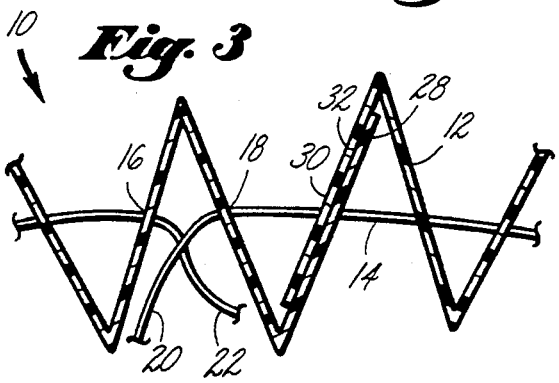
FIG. 3 is a section view in the direction of arrows 3—3 in FIG. 1.

Referring additionally to FIG. 3, edge panels 28 and 30 of pleated sheet 12 are overlapped and adhered together along surface 32 by conventional adhesive, double-sided adhesive tape, or the like so as to form the generally tubular-shaped member depicted in FIG. 1.

A drawstring 14 formed of a length of thin, flexible cord material is positioned in in-and-out fashion through holes formed adjacent the upper margin 24 of the pleated sheet 12. The ends 20 and 22 of drawstring 14 exit through adjacent holes at 16 and 18 so as to be tightenable and tieable after suitably reducing the circumference of the upper end 24 of the tubular-shaped pleated sheet 12. Alternately, the flexible cord 14 may be elastic and continuous.

Figure 2:
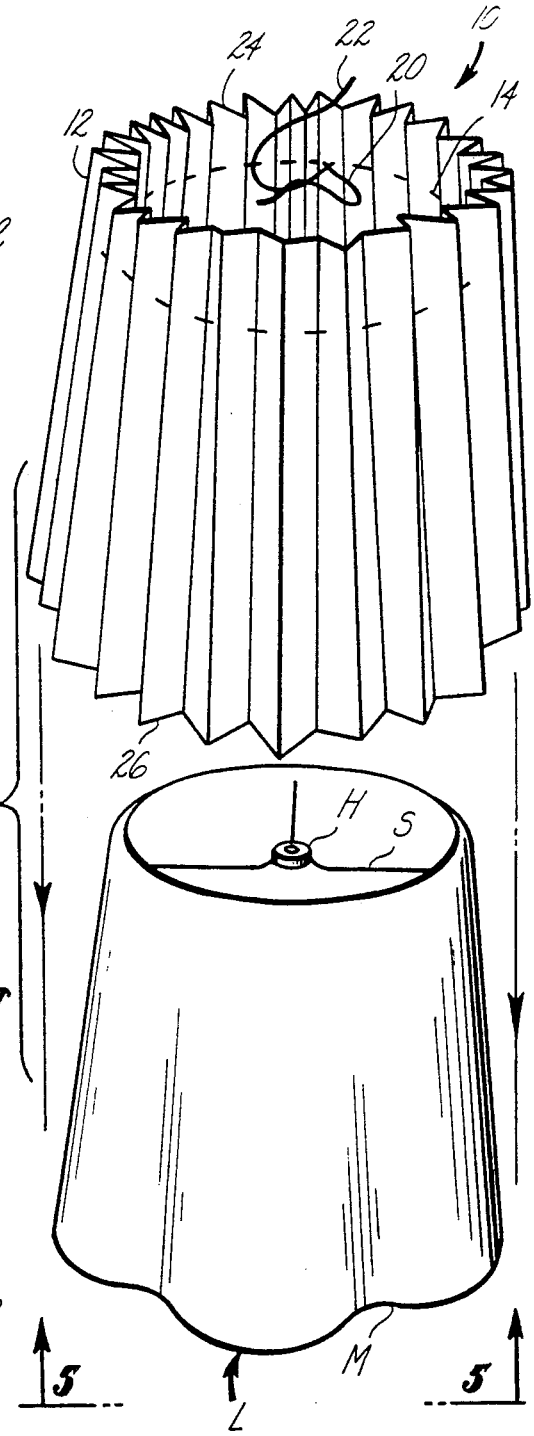
FIG. 2 is an exploded view of the invention shown in FIG. 1 fitted over a conventional lamp shade.

Referring additionally to FIG. 2, the overshade 10 is shown having drawstring 14 tensioned so as to have reduced the circumference of upper margin 24 ready for slidable fitting downwardly over a conventional lamp shade L. No further preparation is required to fit the device 10 in snug position over and substantially or fully covering the lamp shade L. Because most lamp shades are tapered upwardly, coupled with the tensioning and securing of drawstring 14, the device 10 will remain in position decoratively covering the lamp shade L, aided primarily by the force of gravity and surface friction between the inner surface of the device 10 and the outer surface of lamp shade L.

Figure 4:
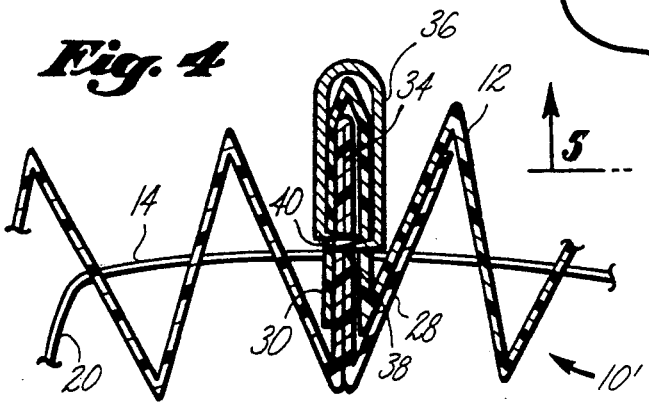
FIG. 4 is a section view similar to FIG. 3 showing an alternate connecting means between the free side margins of the pleated rectangular sheet.

Referring now to FIG. 4, an alternate embodiment of the connecting means between the edge panels 28 and 30 of the pleated sheet 12 is there depicted at 10°. This connecting means is in the form of a U-shaped metal or plastic clip 36 having opposing inwardly projecting barbs 38 and 40 which pierce through the corresponding layers of overlapping panel material to secure and maintain the tubular shape.

Referring now to FIGS. 5 and 6, the compliability of the embodiments 10 and 10' of the invention around irregular shaped lamp shades L and L' each having its own distinctively shaped upper and lower margins N and M or N' and M1' is there shown. Thus, from the standpoint of both size and shape accommodation, either embodiment of the invention 10 or 10' is fully capable of expanding as required and exhibiting sufficient pliability so as to generally maintain the overall shape of the lamp shade L or L'.

Moreover, the length of the tubular member 12 may be selected so as to be substantially longer than the height of the lamp shade and drawstring 14 may be tensioned such that either the upper margin 24 or the lower margin 26 may extend either above, or below, the upper or lower margins, respectively of a lamp shade. Because of the relatively stiff nature of the pleated sheet, the overall tubular shape, in the form of a truncated cone as in FIG. 2, will uniformly extend the existing shape of the lamp shade itself so as to alter the decorative impact thereof.

Referring lastly to FIG. 7, the invention is shown in another alternate form at 10'' in its fully folded or stored configuration. In this embodiment 10'', the same pleated sheet 12 is adhered along overlapping edge panels 28 and 30 and the panel adjacent to each so as to increase the overall strength of the tubular shape.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A universal foldable lamp shade overshade comprising:

a uniformly pleated rectangular sheet of thin, bendable material;

said pleated sheet defined by a plurality of side-by-side slender elongated rectangular panels integrally connected one to another in accordion fashion along a fold line between each said pleated panel ending in an end panel at each end of said pleated sheet;

a hole formed through each said panel uniformly positioned from, and close to, the upper margin of said pleated sheet;

means for connecting said end panels together to form a generally tubular member;

a drawstring extending through each said hole in alternate in-and-out fashion around said tubular member and exiting at each end of said drawstring from two adjacent said holes, said drawstring longer than the relaxed circumference of said tubular member;

said tubular member having a relaxed circumference sized to fit around an upwardly tapering lamp shade;

said tubular member reducible in circumference at its upper end by shortening said drawstring to provide an only means for hanging support of said tubular member in position over the lamp shade whereby said tubular member will rest over and substantially cover the lamp shade, remaining thusly primarily by the force of gravity.

2. A universal foldable lamp shade overshade as set forth in said connection means is adhesive.

3. A universal foldable lamp shade overshade as set forth in claim 1, wherein:

said connecting means is a self-engaging barbed clip.

4. A universal foldable lamp shade overshade as set forth in claim 1, wherein:

said tubular member is sized to expand and fit over a wide range of circumferences of lamp shades.

5. A universal foldable lamp shade overshade as set forth in claim 1, wherein:

said tubular member has a length substantially longer than the height of the lamp shade.

6. A universal foldable lamp shade overshade as set forth in claim 1, wherein:

said tubular member is sufficiently compliant along said fold lines to conform around non-circular lamp shades.

7. A universal foldable lamp shade overshade as set forth in claim 1, wherein:

said tubular member is collapsible along said fold lines into a compressed configuration for storage.

8. A universal foldable lamp shade overshade as set forth in claim 1, wherein:

said drawstring is elastic.

9. In combination, a lamp shade cover cooperatively structured to loosely fit over and be supported only by an upwardly tapered lamp shade, said lamp shade cover comprising:

a uniformly pleated rectangular sheet of thin, bendable material;

said pleated sheet defined by a plurality of side-by-side slender elongated rectangular panels integrally connected one to another in accordion fashion along a fold line between each said pleated panel ending in an end panel at each end of said pleated sheet;

a hole formed through each said panel uniformly positioned from, and close to, the upper margin of said pleated sheet;

means for connecting said end panels together to form a generally tubular member;

a drawstring extending through each said hole in alternate in-and-out fashion around said tubular member and exiting at each end of said drawstring from two adjacent said holes, said drawstring longer than the relaxed circumference of said tubular member;

said tubular member having a relaxed circumference sized to fit around said lamp shade;

said tubular member reducible in circumference at its upper end by shortening said drawstring to provide an only means for supporting said tubular member in position over said lamp shade whereby said tubular member substantially covers the lamp shade, remaining thusly primarily by the force of gravity.

* * * * *